US008647012B2

(12) United States Patent
Wilkinson et al.

(10) Patent No.: US 8,647,012 B2
(45) Date of Patent: Feb. 11, 2014

(54) GATE FOR BARRIER SYSTEM AND METHODS FOR THE ASSEMBLY AND USE THEREOF

(75) Inventors: Douglas E. Wilkinson, Auburn, CA (US); Anthony R. Van Brocklin, Woodland, CA (US); Barry D. Stephens, Roseville, CA (US)

(73) Assignee: Energy Absorption Systems, Inc., Dallas, TX (US)

( * ) Notice: Subject to any disclaimer, the term of this patent is extended or adjusted under 35 U.S.C. 154(b) by 147 days.

(21) Appl. No.: 13/095,309

(22) Filed: Apr. 27, 2011

(65) Prior Publication Data

US 2011/0271597 A1 Nov. 10, 2011

Related U.S. Application Data

(60) Provisional application No. 61/331,582, filed on May 5, 2010.

(51) Int. Cl.
*E01F 13/00* (2006.01)

(52) U.S. Cl.
USPC ..... 404/6; 256/13.1

(58) Field of Classification Search
USPC ..... 404/6, 9, 10, 12; 49/49; 256/13.1, 14, 256/73; 16/86.1, 260–263, 270–272, 319, 16/352, 353, 365, 366, 368, 369, 371, 231
See application file for complete search history.

(56) References Cited

U.S. PATENT DOCUMENTS

| | | | | |
|---|---|---|---|---|
| 1,141,828 | A * | 6/1915 | Rhody | 16/230 |
| 4,666,332 | A | 5/1987 | Burgett | |
| 4,681,302 | A | 7/1987 | Thompson | |
| 4,815,889 | A | 3/1989 | Duckett | |
| 5,009,542 | A * | 4/1991 | Hardin et al. | 404/6 |
| 5,181,794 | A * | 1/1993 | Wilson et al. | 404/6 |
| 5,551,796 | A * | 9/1996 | Anderson et al. | 404/6 |
| 6,059,491 | A | 5/2000 | Striefel et al. | |
| 6,203,242 | B1 | 3/2001 | Englund | |
| 6,402,421 | B1 * | 6/2002 | Ottavi et al. | 404/6 |
| 6,439,802 | B1 | 8/2002 | Duckett | |
| 6,485,224 | B1 | 11/2002 | Dyke et al. | |
| 6,712,545 | B2 | 3/2004 | Muller et al. | |

(Continued)

FOREIGN PATENT DOCUMENTS

| | | | |
|---|---|---|---|
| AU | 2002234013 | B2 | 4/2007 |
| DE | 4333577 | A1 | 4/1995 |

(Continued)

OTHER PUBLICATIONS

International Search Report and Written Opinion of the International Searching Authority for International Application No. PCT/US2011/034886, dated Aug. 1, 2011, 6 pages.

(Continued)

*Primary Examiner* — Matthew D Troutman
(74) *Attorney, Agent, or Firm* — Brinks Gilson & Lione

(57) ABSTRACT

A gate for providing an opening in a barrier system includes a gate barrier segment and a connector having first and second connector segments. The first connector segment is coupled to the gate barrier segment. The first and second connector segments are releasably coupled, and may be hingedly connected on at least one of a first and second side thereof. The second connector segment is configured to be coupled to a stationary barrier segment.

13 Claims, 9 Drawing Sheets

(56) References Cited

U.S. PATENT DOCUMENTS

| | | | | |
|---|---|---|---|---|
| 6,832,870 | B1 | 12/2004 | Krivoy | |
| 7,100,243 | B1 * | 9/2006 | Platzke | 16/326 |
| 7,393,154 | B1 | 7/2008 | Dyke et al. | |
| 7,566,187 | B2 * | 7/2009 | Dyke et al. | 404/6 |
| 2007/0253771 | A1 | 11/2007 | Hotchkin | |
| 2008/0286042 | A1 | 11/2008 | Dyke et al. | |

FOREIGN PATENT DOCUMENTS

| | | | |
|---|---|---|---|
| DE | 10231903 | A1 | 2/2004 |
| DE | 202006013759 | U1 | 11/2006 |
| EP | 0758698 | B1 | 12/1999 |
| EP | 1186714 | A2 | 3/2002 |
| EP | 1247905 | A2 | 10/2002 |
| EP | 1619312 | A1 | 1/2006 |
| EP | 1854923 | A1 | 11/2007 |
| FR | 2701499 | A1 | 8/1994 |
| FR | 2741093 | A1 | 5/1997 |
| GB | 2315510 | A | 2/1998 |
| WO | WO 02/055790 | A1 | 7/2002 |
| WO | WO 2005/003465 | A1 | 1/2005 |
| WO | WO 2005/085533 | A1 | 9/2005 |
| WO | WO 2006/081783 | A1 | 8/2006 |
| WO | WO 2007/036239 | A1 | 4/2007 |
| WO | WO 2008/091304 | A2 | 7/2008 |

OTHER PUBLICATIONS

Vicroads, Worksite Safety Update, Update 45, Feb. 2006, 7 pages.

* cited by examiner 2
4
6
15
16
18
20
22
24
26
28
30
34
36
38
40
52
70
78
80
82
84
d1

GATE FOR BARRIER SYSTEM AND METHODS FOR THE ASSEMBLY AND USE THEREOF

This application claims the benefit of U.S. Provisional Application No. 61/331,582, filed May 5, 2010, the entire disclosure of which is hereby incorporated herein by reference.

FIELD OF THE INVENTION

The present invention relates generally to a barrier system, and in particular, to a gate for a barrier system providing an opening therethrough.

BACKGROUND

Barrier systems are commonly used to separate and define work zones and/or to separate lanes of traffic from each other, or from various hazards. Such barrier systems may be configured from a plurality of concrete, steel or plastic barrier segments connected end-to-end. Often, it is desirable to provide an opening in the barrier system so as to allow vehicles to pass through the barrier system, for example to gain access to a work zone, rather than circling around the entire barrier system. The opening may be marked and closed with a visual barrier, such as a chain or rope, or may include a conventional hinged gate. These types of barriers, however, do not have the same strength and redirective capabilities as the adjacent barrier system.

Alternatively, temporary removal of one of the barrier segments to form the opening may not be suitable, as the barrier segments may be restricted by end constraints or lack portability. Other solutions, such as providing overlapping, but spaced apart barrier segments, require additional space, limit the angle of entry, are not easily reconfigurable and may require additional segments, all of which may affect the suitability of such systems.

SUMMARY

The present invention is defined by the following claims, and nothing in this section should be considered to be a limitation on those claims.

In one aspect, one embodiment of a gate for providing an opening in a barrier system includes a stationary barrier segment, a gate barrier segment and a connector having first and second connector segments. The first connector segment is releasably and non-pivotably coupled to the gate barrier segment with a first vertically removable connector pin. The first and second connector segments are releasably coupled with a second vertically removable connector pin. The second connector pin is moveable between an engaged position, wherein the first and second connector segments are non-pivotably coupled, and a disengaged position, wherein the first and second connector segments are pivotable relative to each other. The second connector segment is releasably and non-pivotably coupled to the stationary barrier segment with a third vertically removable connector pin.

In another aspect, one embodiment of a connector for a gate providing an opening in a barrier system includes a first connector segment having a first end portion having first and second hinge components disposed on opposite, horizontally spaced sides of the first connector segment. A second connector segment has a second end portions including third and fourth hinge components disposed on opposite, horizontally spaced sides of the second connector segment. A hinge connector is moveable between a disengaged position, a first engaged position, wherein the hinge connector hingedly connects the first and third hinge components, and a second engaged position, wherein the hinge connector hingedly connects the second and fourth hinge components.

In yet another aspect, a connector for a gate providing an opening in a barrier system includes a first connector segment having first and second longitudinally spaced end portions and first and second sides. The first end portion is configured to be coupled to a first barrier segment. A second connector segment has first and second longitudinally spaced end portions and first and second sides. The first end portion is configured to be coupled to a second barrier segment. The first and second connector segments define a gap between the second sides thereof. A wedge member is disposed in and closes the gap. A pair of connector pins secures the wedge member to the first and second connector segments respectively.

In yet another aspect, one embodiment of a connector segment for a gate providing an opening in a barrier system includes longitudinally spaced first and second end portions, a first side having a first length extending in a longitudinal direction from the first end portion and a second side parallel to and horizontally spaced from the first side in a lateral direction. The second side has a second length extending in a longitudinal direction from the first end portion. In one embodiment, the first and second sides are longitudinally offset at one end thereof. In one embodiment, the second length is greater than the first length. In one embodiment, first and second hinge components are disposed on the first and second sides respectively adjacent the first end portion.

In yet another aspect, one embodiment of a method of opening a gate in a barrier system includes decoupling a first end of a gate barrier segment from an adjacent first barrier segment, releasing first and second connector segments coupling respectively a second end of the gate barrier segment with an adjacent second barrier segment such that the first connector segment and the gate barrier segment are moveable relative to the second connector segment and the second barrier segment. The method further includes hingedly connecting the first and second connector segments on one of a first or second opposite sides of the first and second connector segments, wherein the first and second sides are horizontally spaced in a lateral direction. The method further includes pivoting the first connector segment and the gate barrier segment about the hinged connection on the selected one of the first or second sides of the first and second connectors.

The various embodiments of the barrier system and gate, and methods of use thereof, provide significant advantages over other barrier systems and gates in such systems. For example and without limitation, the gate may be opened in either rotation direction, including a rotation of 180 degrees, thereby minimizing the footprint of the system in an open configuration. In addition, the connector(s) may be quickly and easily installed in a line of barrier segments. The connectors, with the gate in a closed position, are robust and maintain the overall integrity of the barrier system, and include side rails having a profile matching the adjacent barrier segments, thereby eliminating the risk of snagging. The connector also provides a mechanism for maintaining a connection even when lifting one or more barrier segments, thereby improving the overall robustness of the system. Conversely, the connector provides for a gate to be completely disconnected from the barrier system, whereinafter the gate may moved to a desired location. In one embodiment, the connectors may be positioned side by side, rather than in a mating configuration, with a wedge member sandwiched between the connectors. In such an embodiment, the gate may be pivoted in either direction.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction of a barrier segment, or assembly thereof. The term "lateral," as used herein, means directed between or toward (or perpendicular to) the side of the barrier segments. The term "coupled" means connected to or engaged with, whether directly or indirectly, for example with an intervening member, and does not require the engagement to be fixed or permanent, although it may be fixed or permanent. The term "transverse" means extending across an axis, and/or substantially perpendicular to an axis. It should be understood that the use of numerical terms "first," "second," "third," etc., as used herein does not refer to any particular sequence or order of components; for example "first" and "second" connector segments may refer to any sequence of such segments, and is not limited to the first and second connector segments of a particular configuration unless otherwise specified.

Referring to FIGS. 1, 4 and 6-11, various barrier systems are shown as including a plurality of stationary barrier segments 2. The term "stationary," as used herein, simply refers to a component, such as a barrier segment, that is generally immobile during normal use and operation, i.e., when defining a work zone or protecting workers and/or vehicle occupants. However, a stationary barrier segment does not mean the barrier segment is not capable of being moved, for example when a barrier system is being reconfigured with a barrier moving device so as to redefine a workzone, or when a caster system is deployed beneath the barrier segment.

Figures 1, 2, 3:
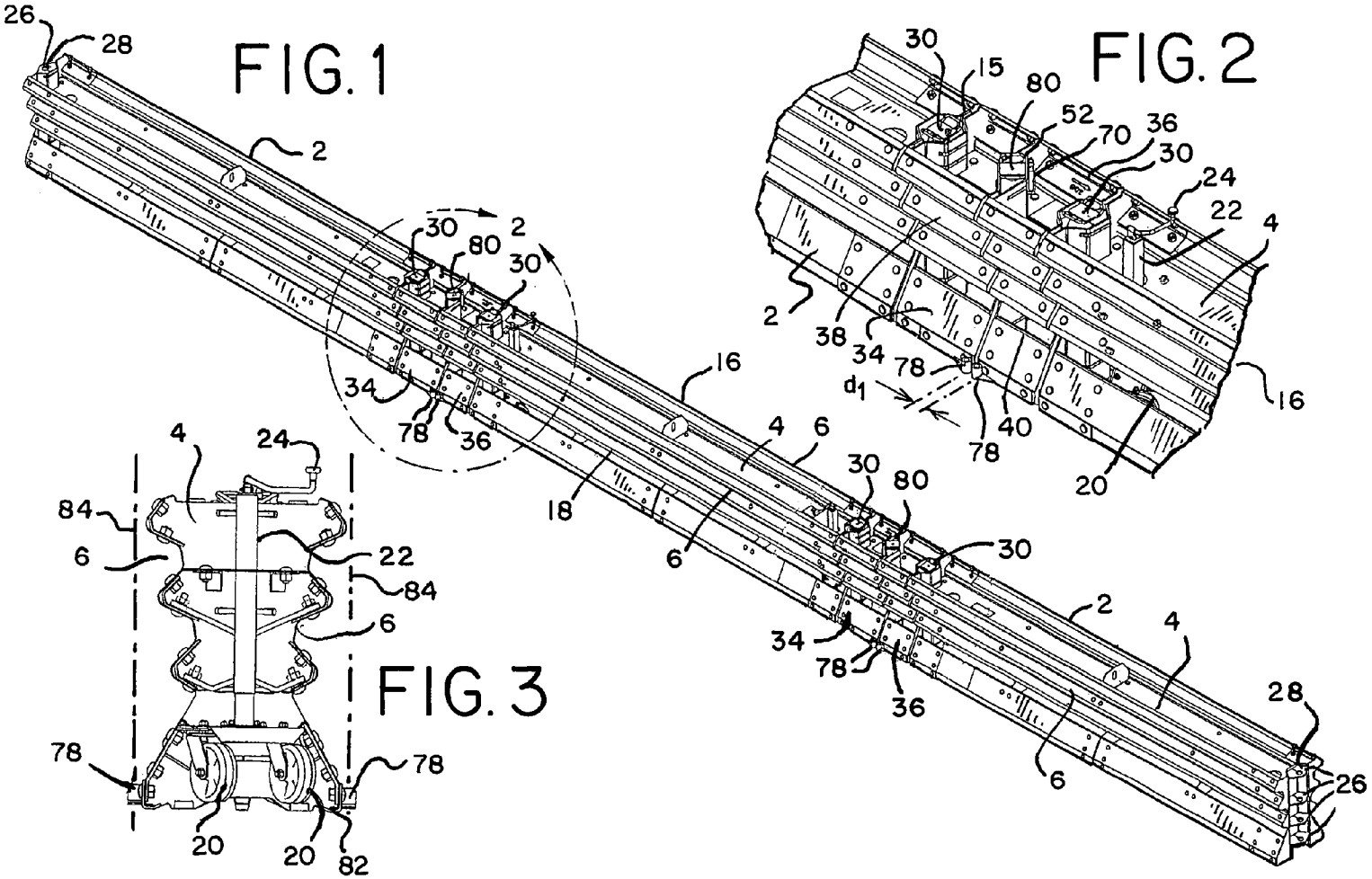
FIG. 1 is a perspective view of one embodiment of a partial barrier system having a pair of stationary barrier segments and a gate barrier segment connected thereto with a pair of connectors in a closed position.
FIG. 2 is an enlarged perspective view of one connector coupled between a stationary barrier segment and a gate barrier segment take along line 2 in FIG. 1.
FIG. 3 is an end view of the gate barrier segment.

In one embodiment, shown for example in FIG. 1, stationary barrier segments 2 are configured as steel barriers, including an internal frame 4 and at least one rail section 6 disposed along each side of the barrier segment. The rail sections may be configured as AASHTO M-180 thrie-beam guardrail segments (Standard Specification for Corrugated Sheet Steel Beams for Highway Guardrail, AASHTO Designation: M 180-00 (2004)), American Association of State Highway and Transportation Officials, Washington D.C., 2004. Alternatively, the rail segments may be configured with a W-shaped cross section, or other suitable cross-sectional shapes. One suitable steel barrier is the VULCAN barrier available from Energy Absorption Systems, Inc., the Assignee of the present application. Other embodiments of stationary barrier segments include plastic, water-filled barriers, concrete barriers 8, transition segments 10 and/or combinations thereof, as shown for example in FIGS. 6-11. The stationary barrier segments 2, 8, 10 are joined end-to-end, for example with a vertical connector pin.

Referring to FIGS. 1, 4 and 6-13, an opening 14 is formed between at least a pair of longitudinally spaced stationary barrier segments 2. 8, 10. The opening 14 is positioned in a desired location along the barrier system to permit vehicles, such as construction vehicles, to pass through the opening from one side of the barrier system to the other. The opening may also be provided to permit diverted traffic to pass from one side of the barrier system to the other.

In order to maintain the integrity and robustness of the barrier system, a gate 16 is moveable between various open positions on one or both sides of the barrier system to a closed position, wherein the opening is closed. The gate may be configured from various gate barrier segments 18 (one or more) having a construction identical to the stationary barrier segments. However, the gate 16 is intended to move during the normal use and operation of the barrier system. For example, one suitable gate is configured as one of the VULCAN barrier segments referred to above. The gate barrier segment 18 is preferably configured with a pair of wheels 20 at each end thereof. In one embodiment, the wheels are configured as freely rotatable casters. The wheels may be raised and lowered with a jack 22 having a rotatable handle 24. In one embodiment, the ends of the stationary and gate barrier segments 2, 8, 10 are configured with a plurality of lugs 26 having vertically aligned openings 28. Adjacent stationary barriers are secured one to another with a removable connector pin 30 disposed through the openings 28. In various embodiments, the gate 16 is configured with a single gate barrier segment 18 (FIGS. 1 and 4), while in other embodiments, the gate is configured with a plurality (shown as two) gate barrier segments 18 (FIGS. 6-11).

Referring to FIGS. 1, 2, 4, 5 and 12A-13B, connectors 32 are positioned on opposite ends of the gate 16, regardless of whether the gate is formed from a single gate barrier segment 18 (FIGS. 1, 2 and 4-6) or a plurality of gate barrier segments 18 (FIGS. 6-11). Each connector includes first and second connector segments 34, 36 and which have the same shape in plan view, but are individually asymmetrical. The sides 38, 40 of the segments are configured with rails 42, 44 that are shaped and configured to mate with and match the side profile of the adjacent barrier segments, whether a stationary or gate barrier segment. For example, the rails may be configured as corrugated thrie beams.

Figure 12B:
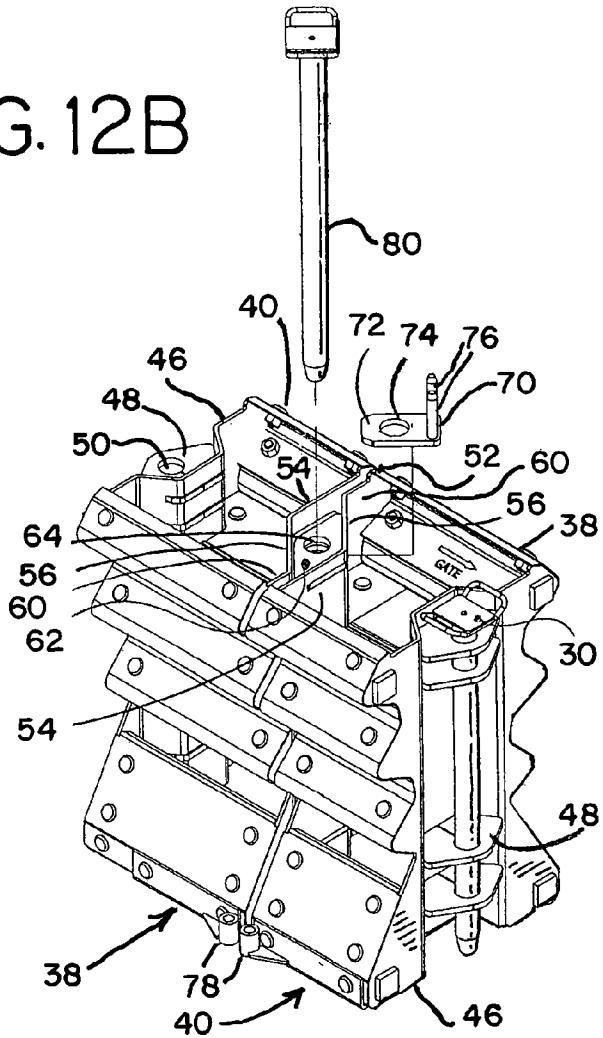
FIGS. 12A and B are assembled and exploded perspective views of one embodiment of a connector.
Figure 12A:
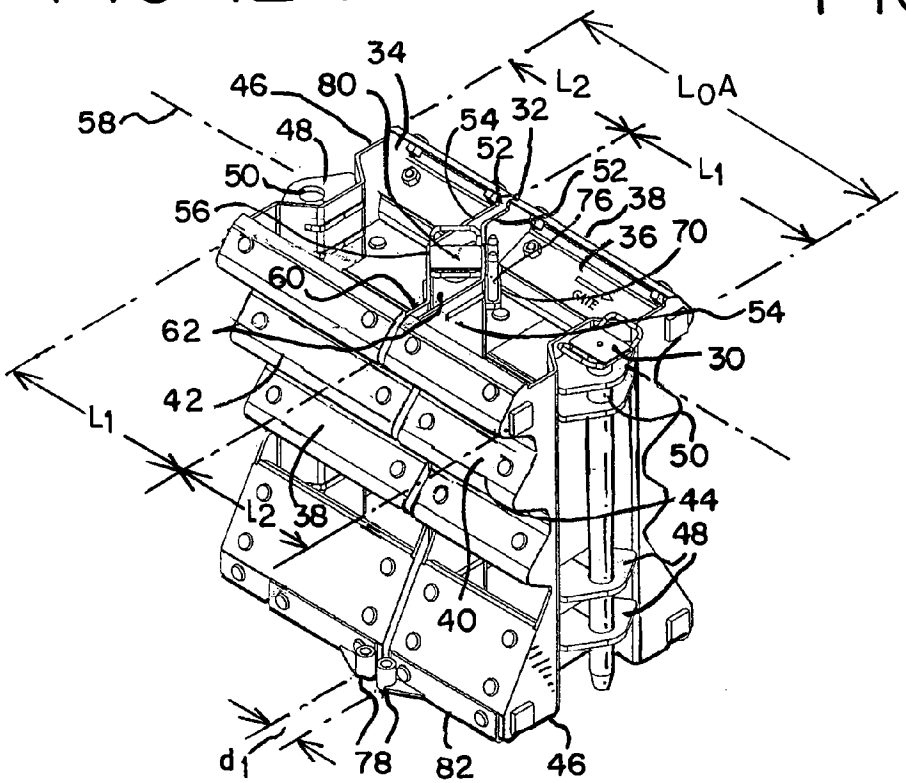

In a first embodiment, shown in FIGS. 12A and B, each connector segment 34, 36 has opposite, laterally spaced sides 38, 40, with the sides having different horizontal lengths extending in a longitudinal direction. A first side 38 of the first connector segment has the same length (L1) as an opposite side of the second connector segment, while a second side 40 has the same length (L2) as an opposite second side of the second connector segments, with the overall length (LOA=L1+L2) of each side of the connector being the same when the connector segments are joined. The length L1 is greater than the length L2. In one embodiment, the first length is about 17.5 inches, while the second length is about 12.5 inches, with the difference (d1) being about 5 inches. The end portions 46 of each connector segment have the same configuration as the mating stationary or gate barrier segments, and include in one embodiment a plurality of vertically spaced lugs 48 with openings 50 shaped to mate with the interfacing lugs 26. The connector 32 is releasably and non-pivotably connected to and between the stationary barrier segment 2 and the gate 16 with a pair of connector pins 30. It should be understood that the term "non-pivotably" refers to less than about 6 degrees of rotation between such components, since the connector may be pivotable a small amount relative to each of the barrier segment and gate due to a slight spacing between the interfacing end portions of the connector 32 and the respective stationary and gate barrier segments 2, 18. In an alternative embodiment, the connector segments may be integrally formed as an end portion of a respective stationary or gate barrier segment, or the barrier segment configured with an end portion as shown in FIGS. 12A-14 may be thought of as a connector segment, even though it has an overall length substantially the same as the other barrier segment. In this way, a barrier segment may be configured as a connector segment and vice versa, with the barrier/connector segment functioning as either a stationary or gate segment.

Figure 16:
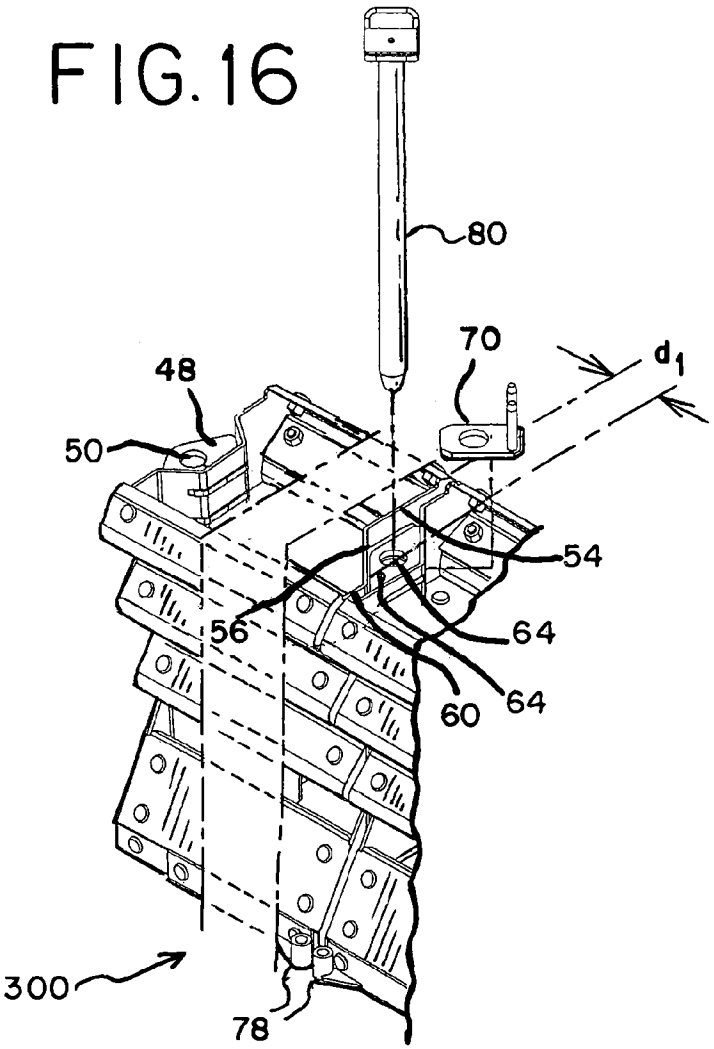
FIG. 16 is an alternative embodiment of a barrier segment with an integrated connector segment at one end.
Figure 15:
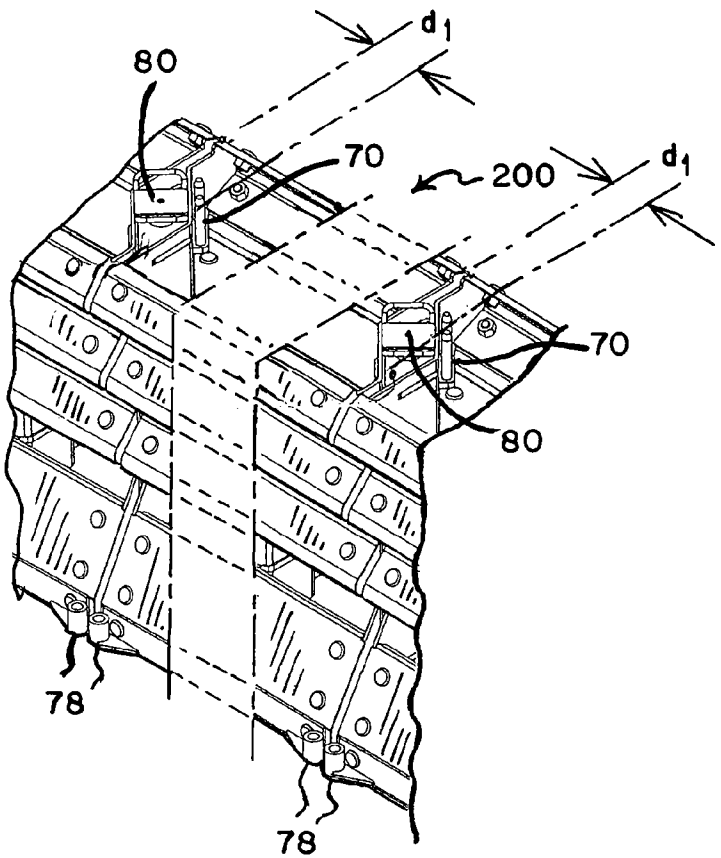
FIG. 15 is an alternative embodiment of a barrier segment with two integrated connector segments at opposite ends.

For example, as shown in FIG. 15, a barrier segment 200 is shown as having two integrated connector segments at each end. In such an embodiment, the overall length of the barrier segment on each side is the same, e.g. 13 feet, 6½ inches, but with each side being shifted or offset a distance d1=L1-L2 in the longitudinal direction. In one embodiment, d1=5 inches. In another embodiment, shown in FIG. 16, the barrier segment 300 is provided with an integrated connector segment at only one end, with the overall length of the opposite sides differing by the distance d1. In one embodiment as shown in FIG. 16, the sides have different lengths, with one side being 13 feet, 6½ inches and the other side being 13 feet 1½ inches.

Referring to FIGS. 12A and B and 4, the opposite, inner end portions 52 of the connector segments are shaped to mate with each other and to accommodate the offset lengths (L1, L2) of the opposite sides 38, 40. In one embodiment, each inner end portion 52 includes a vertical wall 54 extending laterally inwardly from the shorter side 40, a diagonal wall 56 extending from the vertical wall proximate a centerline 58 of the connector and a short vertical wall 60 extending laterally from the diagonal wall to the longer side 38. A plurality of lugs 62, each having a diamond shape in one embodiment, extend horizontally from the vertical and diagonal wall, with an opening 64 formed therethrough at the centerline and with a leading edge 66 lying substantially flush with the short vertical wall 60. The lugs 62 of the interfacing inner end portions are vertically offset such that the connector segments can be mated with the openings in the aligned lugs. A horizontally elongated slot 68 is formed in the diagonal wall 56 below one of the lugs 62, preferably shown in one embodiment as the uppermost lug.

A coupler 70, configured in one embodiment as a plate member 72 with an opening 74 formed therethrough, is slid, or translated, through the slots 68 of the mating connector segments beneath the lugs, with a pair of upright stop members 76 engaging a backside of one of the connector segment vertical walls 56 when the holes 64, 74 are aligned. A vertically removable connector pin 80 is then disposed through the openings 64, 74 in the lugs of the connector segments and the coupler to secure the connector segments 34, 36 in a fixed non-rotatable and non-translatable configuration. The coupler 70 maintains the relative vertical connection/position of the adjacent/joined connector segments, for example when one or both of the adjoining barrier segments are moved, for example when the barrier system is being repositioned by successively lifting and shifting the barrier segments, whether stationary or gate segments.

Each of the connector segments 34, 36 has a hinge component 78, shown as a socket, formed along an outer side thereof adjacent the end thereof as shown in FIGS. 1, 2, 5 and 12A-13B. When the connector segments 34, 36 are coupled with the center connector pin 80, a set of hinge components 78 are longitudinally spaced a small distance (d1) on each side of the connector. The coupler 70 also functions as a hinge connector, with the stop members 76 of the coupler operating as a pair of hinge pins. The hinge pins 76 are disposed in the hinge component sockets 78 after the connector pin 80 and coupler 70 are removed, with the first and second connector segments 34, 36 then being hingedly connected by the hinge connector 70 connecting the hinge components 78. It should be understood that the hinge components on the connector segment may be configured as pins, with the hinge connector configured with mating sockets. Alternatively, one of the hinge components may be socket, and the other a pin, with the hinge connector being matingly configured. The hinge components may be vertically aligned in one embodiment, instead of horizontally spaced as disclosed in the Figures, with the vertically aligned hinge components connected with a single hinge pin. In addition, although the hinge components 78 are preferably positioned adjacent the bottom 82 of the connector segments so as to not interfere with impacting vehicles or otherwise providing a snagging hazard capable of being snagged and the like, it should be understood that the hinge components may be positioned at other vertical locations.

Figures 4, 5, 6:
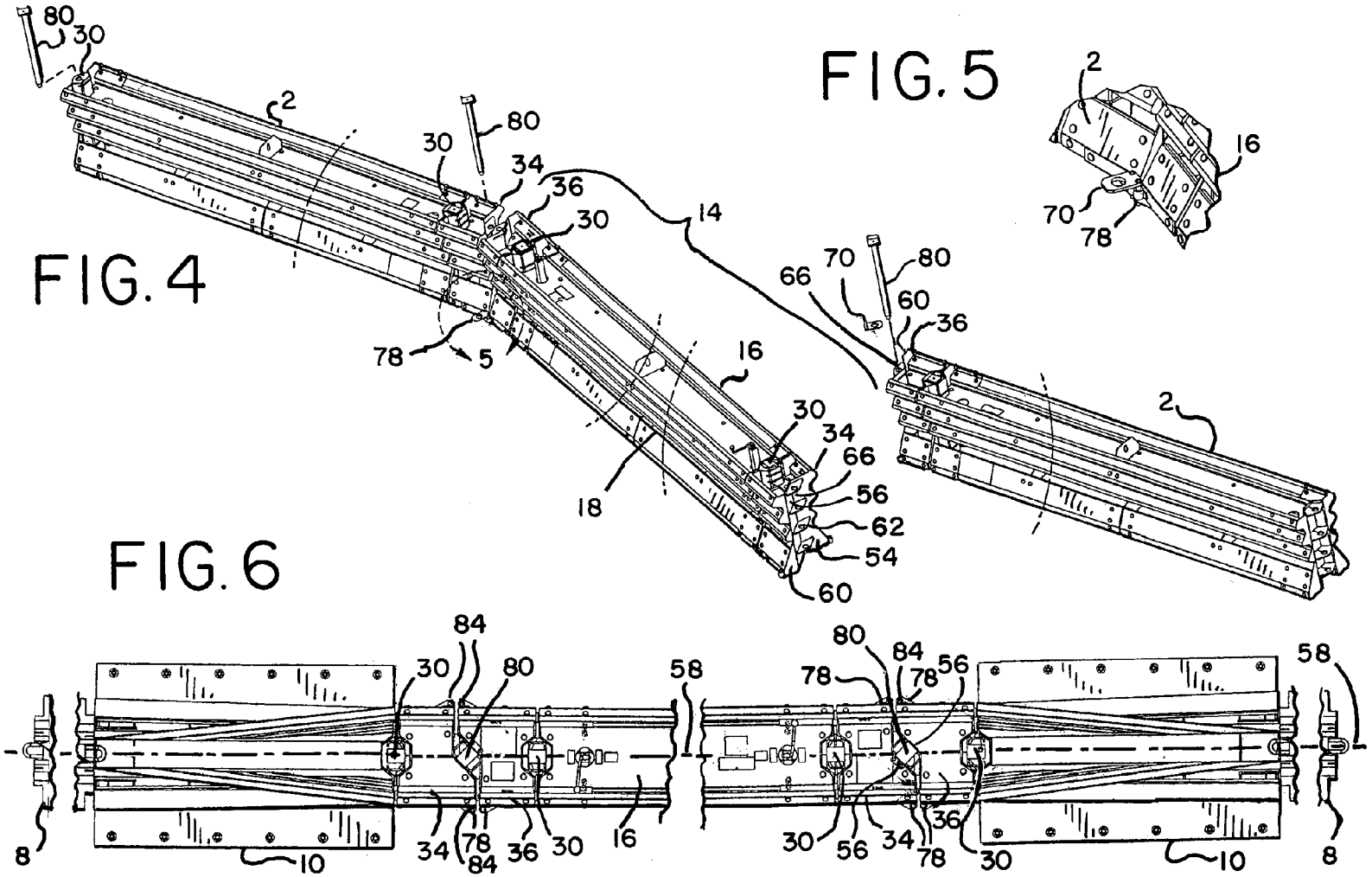
FIG. 4 is a perspective view of one embodiment of a partial barrier system having a pair of stationary barrier segments and a gate barrier segment in an open position.
FIG. 5 is an enlarged view of a hinge connection between first and second connector segments take along line 5 in FIG. 4.
FIG. 6 is a plan view of alternative barrier system having a pair of stationary transition barrier segments coupled to concrete barrier segments and a gate barrier segment connected thereto with a pair of connectors in a closed position.

Referring to FIGS. 3 and 6, the hinge components 78 are preferably located outwardly of the outermost side surface of the connector segments and define hinge axes 84. In this way, a connector segment 34, 36, and a gate 16 connected thereto, may be rotated up to 180 degrees relative to the other connector 34, 36 segment and a stationary barrier segment 2, 8, 10 connected thereto.

Figure 8:
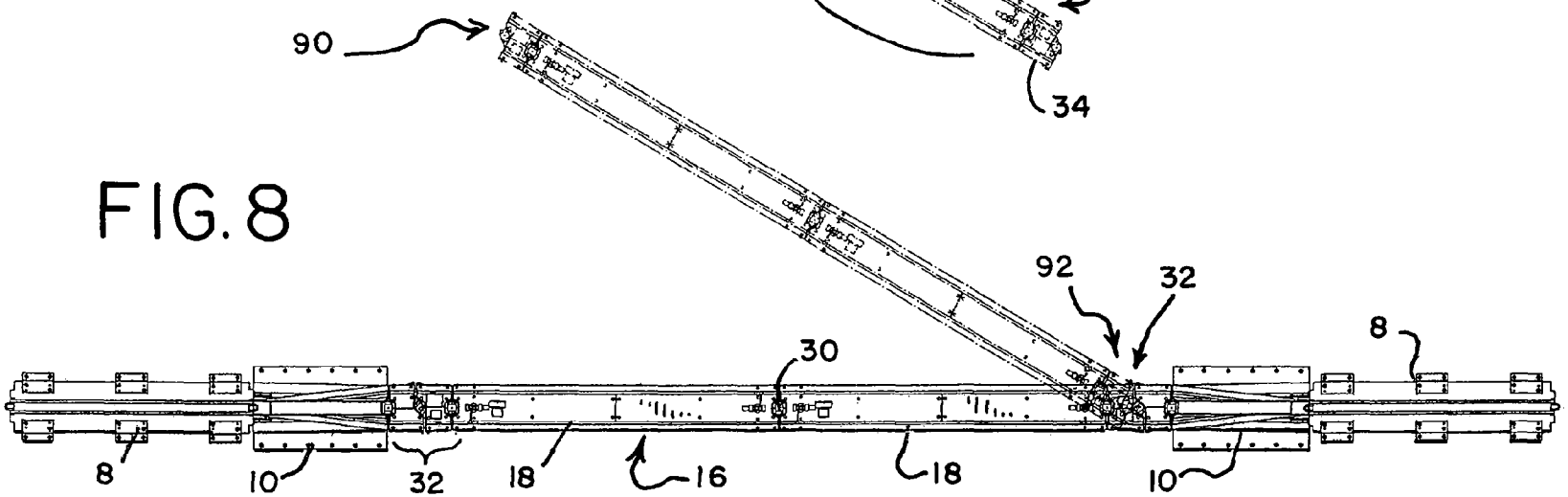
FIG. 8 is a plan view of an alternative barrier system having a gate configured with two barrier segments having a second end coupled to a connector and rotated in a clockwise direction.
Figure 9:
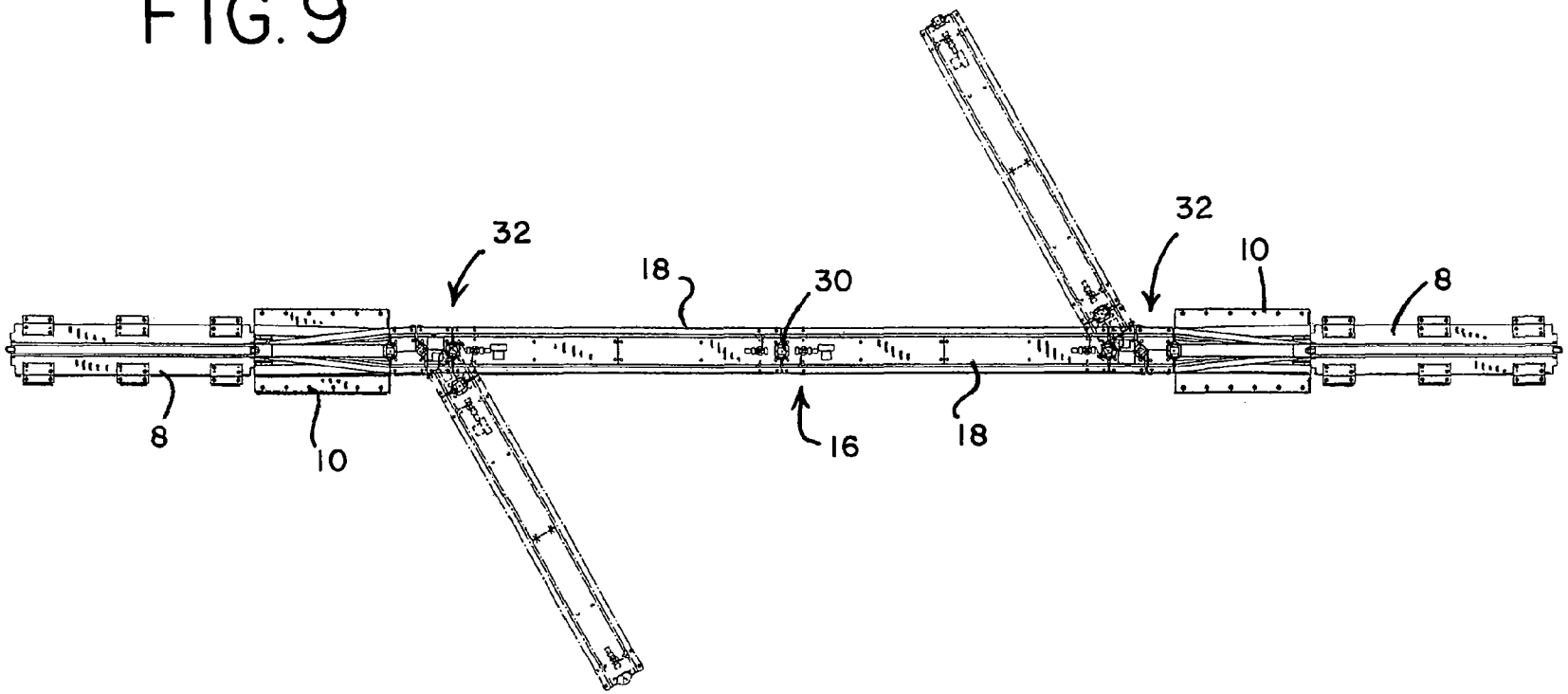
FIG. 9 is a plan view of an alternative barrier system having a gate configured with two barrier segments having first and second ends coupled to a pair of connectors, with the barrier segments rotated in a clockwise direction.
Figure 10:
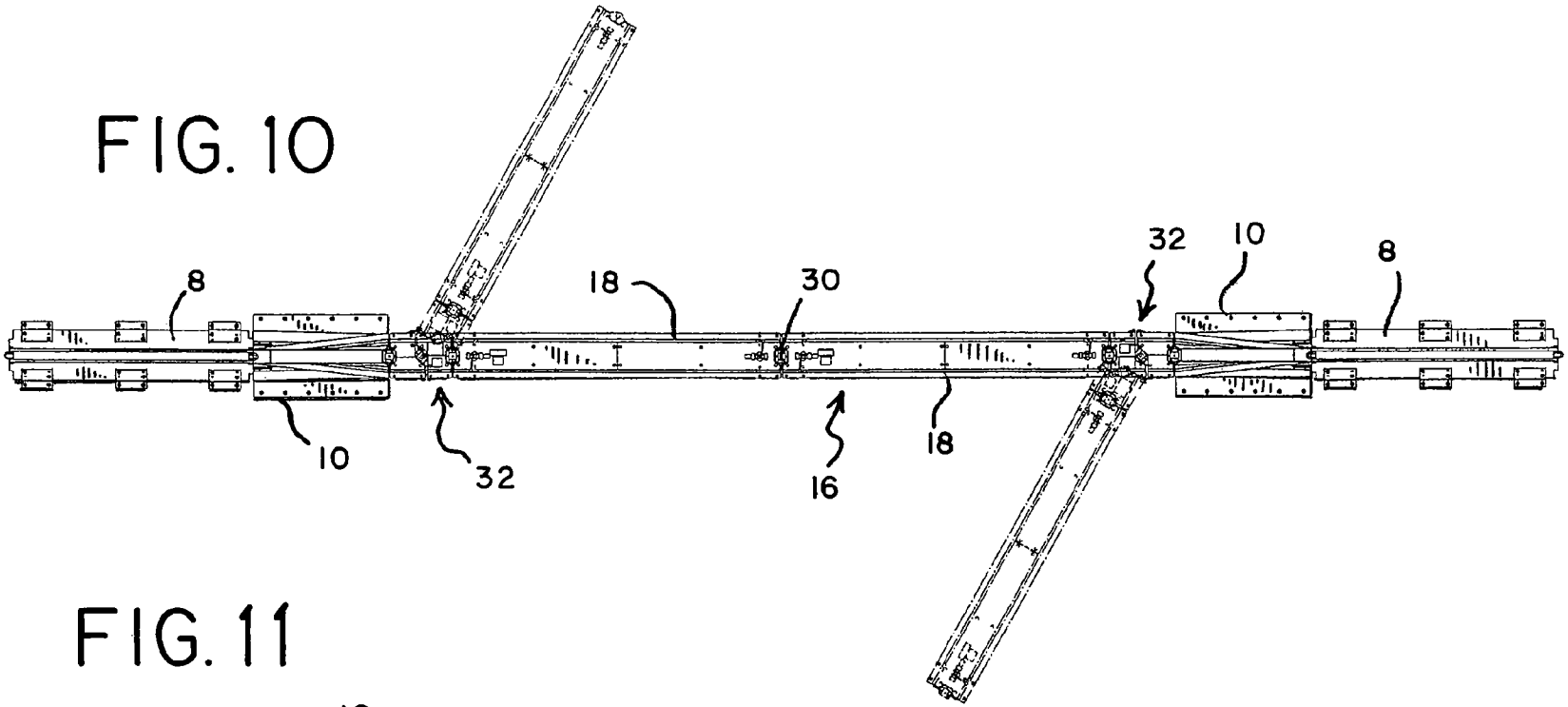
FIG. 10 is a plan view of an alternative barrier system having a gate configured with two barrier segments having first and second ends coupled to a pair of connectors, with the barrier segments rotated in a counterclockwise direction.
Figure 11:
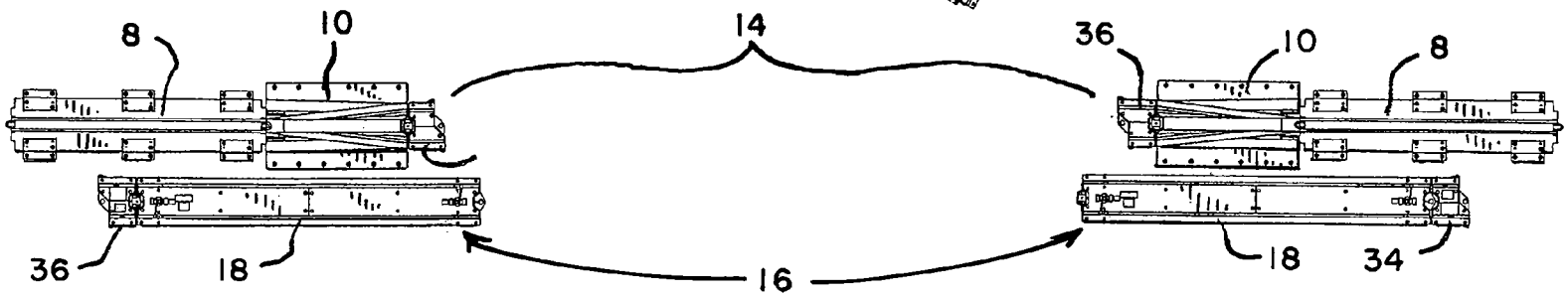
FIG. 11 is a plan view of an alternative barrier system having a gate configured with two barrier segments disconnected from the adjacent barrier segments and moved to a desired location.
Figure 13B:
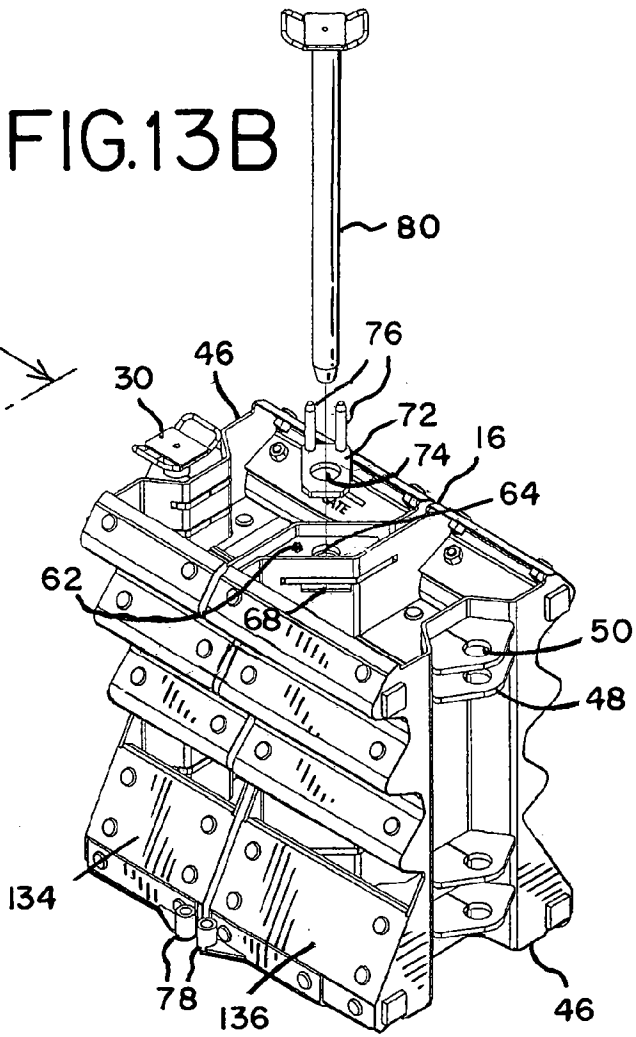
FIGS. 13A and B are assembled and exploded perspective views of another embodiment of a connector.
Figure 13A:
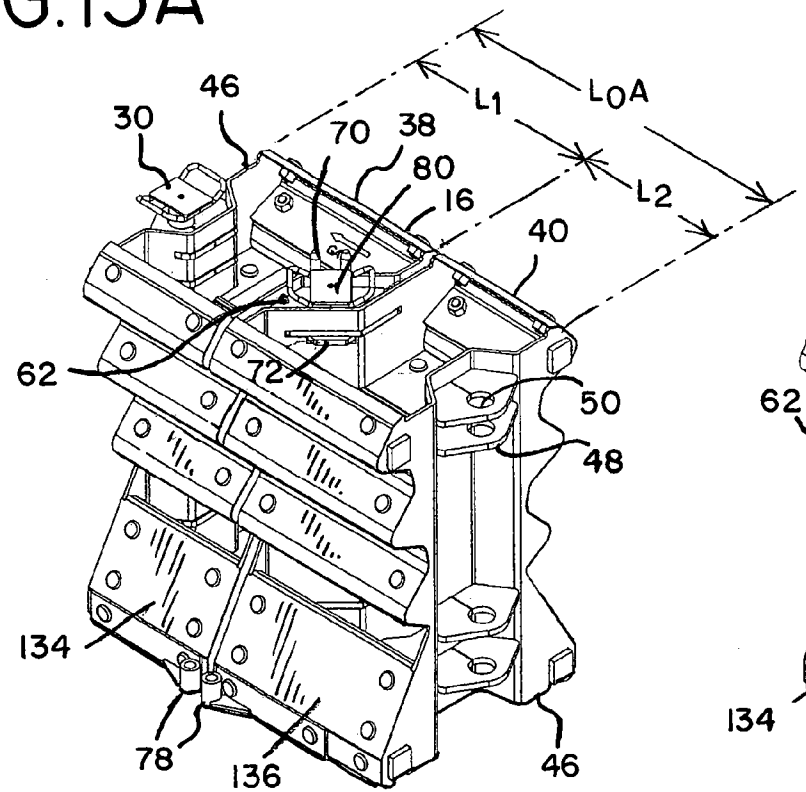

Referring to the embodiment of FIGS. 13A and B, the connector is the same as shown in FIGS. 12A and B, but with the relative lengths L1, L2 of the sides 38, 40 reversed. In this way, if only a single gate barrier segment 18 is being used to define the gate 16, the embodiment of FIGS. 12A and B allow for rotation of the gate in a clockwise direction (see FIGS. 7 and 8), while the embodiment of FIGS. 13A and B allow for rotation of the gate in a counter-clockwise direction. Of course, it should be understood that either embodiment permits rotation about a hinge connector 78, 70 positioned on either side of the connector. Thus, for example when the gate 16 includes a plurality (two or more) of gate barrier segments 18, capable of being decoupled in the middle by removal of a connector pin 30 (see FIGS. 7-11), both of the gate barrier segments may be rotated in either direction (clockwise and counter-clockwise), as shown in FIGS. 9 and 10. In yet another embodiment, the gate barrier segments may be completely decoupled from the stationary barrier segments 10 as shown in FIG. 11.

During assembly, a user first must decide where to position the gate 16 within the barrier system, and determine how many gate barrier segments 18 are needed/desired. If a single gate barrier segment is desired, then the user must also decide whether to use a clockwise or counterclockwise connector (FIGS. 12A-13B). If a plurality of gate barrier segments 18 are used, for example including a pair of gate barrier segments 18 joined with a connector pin 30 (FIGS. 7-11), then either embodiment may be suitable. A pair of connectors 32, each including a pair of connector segments 34, 36, are then releasably and non-pivotably connected to the spaced apart stationary barriers 2, 8, 10 by installing a single, removable connector pin 30 at the interface between each connector 32 and the spaced apart stationary barrier segments. Alternatively, stationary barrier segments provided with integrally formed connector segments may be selected and positioned at the desired and selected location. The gate 16 is also coupled to the connectors 32 at both ends with a single, removable connector pin 30 at each interface, or alternatively is configured with an integrally formed connector segment. The gate may include a single gate barrier segment, or a plurality of gate barrier segments joined with connector pins.

Figure 7:
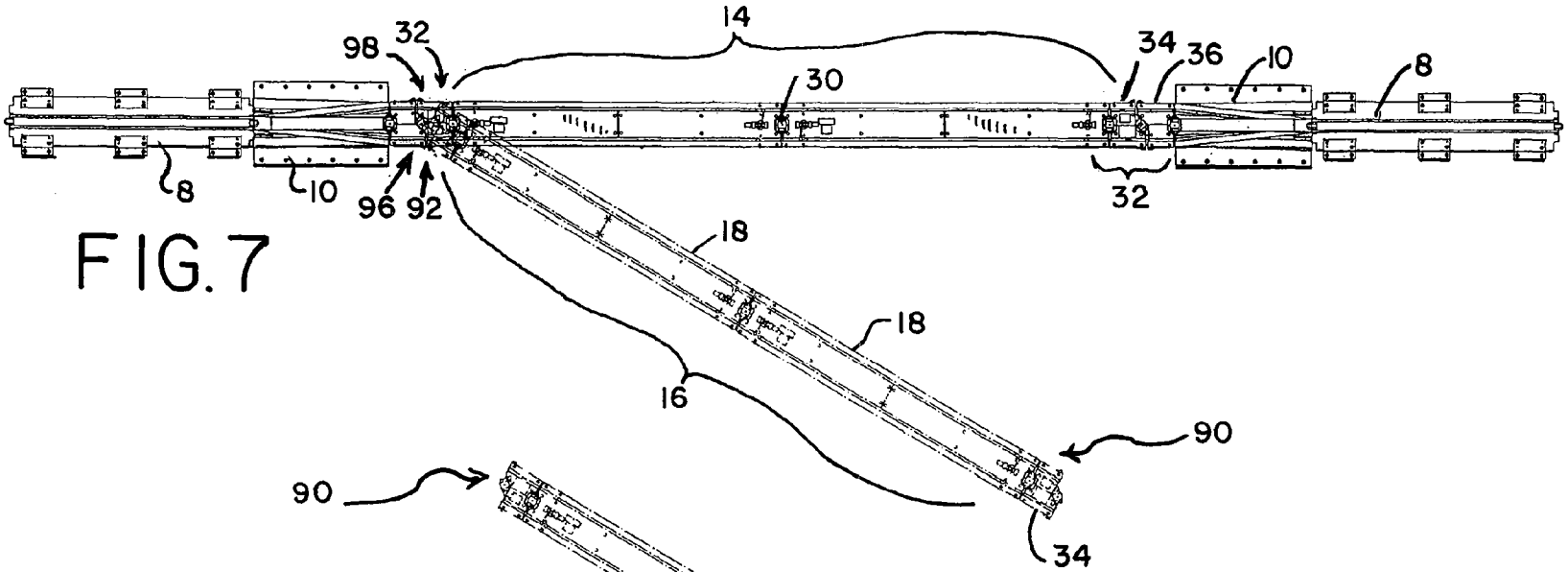
FIG. 7 is a plan view of an alternative barrier system having a gate configured with two barrier segments having a first end coupled to a connector and rotated in a clockwise direction.

In operation, the operator first decides which gate barrier segments are to be opened, from which end thereof, and in which direction (if the gate is configured with a plurality of segments). Referring to FIGS. 7 and 8, the "swinging" end 90 of the gate is decoupled by removing the center connector pin 80 and the coupler 70 from the junction between the connector segments. The "pivot" end 92 of the gate is also decoupled by removing the center connector pin 80 and the coupler 70. The coupler 70 is then installed as a hinge connector received by the set of hinge components 78 to define a hinge on the selected side 96, 98 of the connector at the pivot end of the gate. The wheels 20, if provided, may then be lowered and the gate 16 rotated in the desired direction to a desired location, with the connector segment 34 at the swinging end 90 remaining attached to the gate barrier segment as shown in FIG. 7. As noted above, either end of the gate, both of which are coupled to connectors, may function as the swinging or pivot end, or the gate may be completely disengaged from the stationary barriers and moved, e.g. by rolling, to a desired location. As shown in FIGS. 9 and 10, if the gate is configured with more than two gate barrier segments, the gate barrier segments 18 may simply be decoupled at the junction thereof by removing a single pin 30, with the gate barrier segments then being rotatable relative to each other and to the pivot end 92 of the gate depending on which side 96, 98 the hinge connector 70 has been positioned and engaged with the hinge components 78.

Figure 14B:
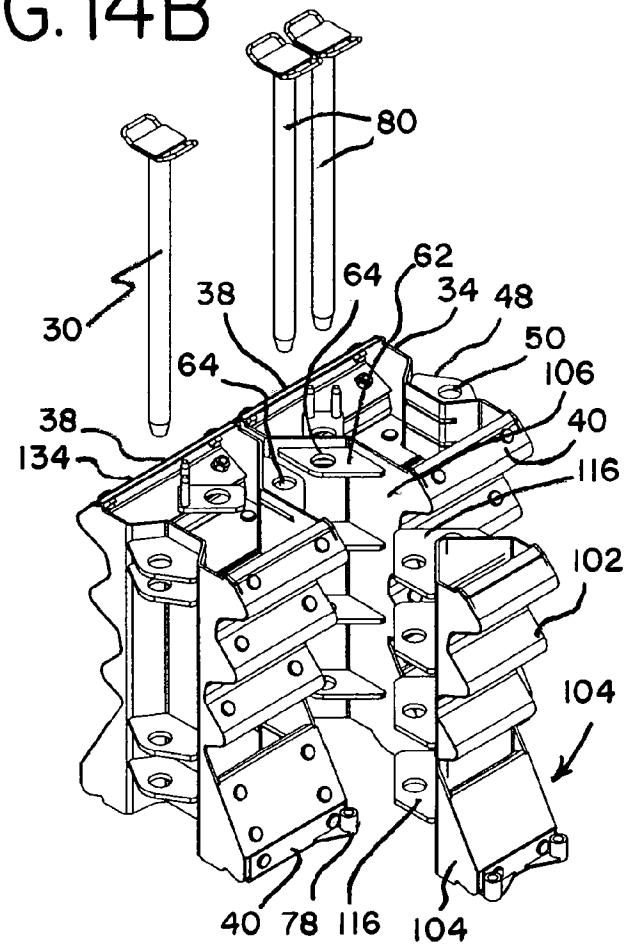
FIGS. 14A and B are assembled and exploded perspective views of another embodiment of a connector.
Figure 14A:
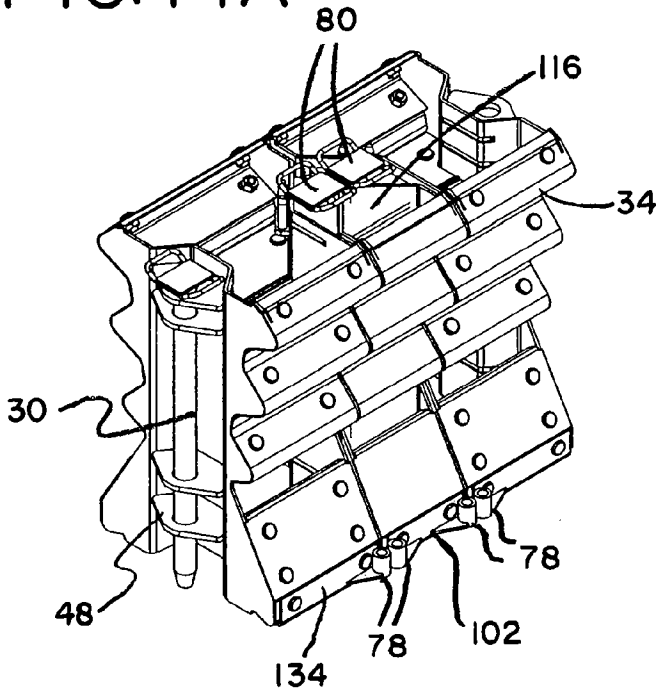

Referring to FIGS. 14A and B, one connector segment 34 from the connector shown in FIGS. 12A and B is combined with one connector segment 134 from the connector shown in FIGS. 13A and B, with the short sides 40 thereof forming a gap 100 therebetween. Again, it should be understood that the connector segments may be integrally formed as end portions of the respective barrier segments. A wedge member 102, having opposite sides 104 that mate with the end walls 106 of the connector segments, is disposed in and closes the gap 100. The wedge member includes at least one lug 116 with a pair of openings 108 spaced along the centerline and shaped to mate with openings 64 in the lugs 62 of the two connector segments 34, 134. A pair of vertically removable connector pins 80 secure the wedge member 102 to the pair of connectors 34, 134 and thereby forms a non-rotatable connector when installed. In addition, a coupler 170 may be disposed through the vertical walls of the adjacent connector segments and secured with the pair of pins. The connector embodiment of FIGS. 14A and B may be positioned at the swing end of a single segment gate, as shown in FIGS. 1 and 4, to provide bi-directional rotation, may be used as a center connector between a pair of gate barrier segments, or may be used at a pivot end of a gate to provide rotation about a hinge formed along the mating long sides 38 thereof.

In operation, the pair of connector pins 80 and the wedge member 102 are removed at the "swinging" end 90 of the gate in one embodiment. In this embodiment, the gate, even if configured as a single gate barrier segment, may be rotated in either direction (clockwise or counterclockwise) due to the relief provided by the gap 100. As mentioned, the connector also may function as the "pivot" end of the gate, but with rotation allowed in only direction.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A gate for providing an opening in a barrier system comprising:

a stationary barrier segment;

a gate barrier segment; and a connector comprising first and second connector segments, wherein said first connector segment is releasably and non-pivotably coupled to said gate barrier segment with a first vertically removable connector pin, wherein said first and second connector segments are releasably coupled with a second vertically removable connector pin, wherein said second connector pin is moveable between an engaged position, wherein said first and second connector segments are non-pivotably coupled, and a disengaged position, wherein said first and second connector segments are pivotable relative to each other, wherein said first and second connector segments are pivotally connected with a hinge connector when said second connector pin is in the disengaged position, and wherein said second connector segment is releasably and non-pivotably coupled to said stationary barrier segment with a third vertically removable connector pin.

2. The gate of claim 1 further comprising a coupler coupling to said first and second connector segments so as to prevent relative vertical movement between said first and second connector segments.

3. The gate of claim 1 wherein said first and second connector segments are pivotable relative to each other in both a clockwise and counterclockwise direction when said second connector pin is in said disengaged position.

4. The gate of claim 1 wherein said first, second and third connector pins are aligned along a centerline of said first and second connector segments.

5. The gate of claim 1 wherein said first and second connector segments are pivotable 180 degrees relative to each other when said second connector pin is moved to said disengaged position.

6. A gate for providing an opening in a barrier system comprising:

a stationary barrier segment;

a gate barrier segment;

a connector comprising first and second connector segments, wherein said first connector segment is releasably and non-pivotably coupled to said gate barrier segment with a first vertically removable connector pin, wherein said first and second connector segments are releasably coupled with a second vertically removable connector pin, wherein said second connector pin is moveable between an engaged position, wherein said first and second connector segments are non-pivotably coupled, and a disengaged position, wherein said first and second connector segments are pivotable relative to each other, and wherein said second connector segment is releasably and non-pivotably coupled to said stationary barrier segment with a third vertically removable connector pin;

a first set of first and second hinge components formed on a first side of said connector at an interface of said first and second connector segments; and a hinge connector releasably connecting said first set of said first and second hinge components on said first side of said connector to permit relative rotation of said first and second connector segments on said first side when said second connector pin is in said disengaged position.

7. The gate of claim 6 further comprising a second set of first and second hinge components formed on a second side of said connector at said interface of said first and second connector segments wherein said first and second sets of first and second hinge components are laterally spaced, and wherein said hinge connector releasably connects one of said first and second sets of said first and second hinge components on one of said first or second sides of said connector to permit relative rotation of said first and second connector segments on said one of said first or second sides when said second connector pin is in said disengaged position.

8. The gate of claim 6 wherein said first and second hinge components comprise first and second sockets, and wherein said hinge connector comprises at least one pin disposed in one of said first and second sockets.

9. The gate of claim 8 wherein said first and second hinge sockets are horizontally spaced, and wherein said at least one pin comprises horizontally spaced first and second pins disposed in said first and second hinge sockets.

10. The gate of claim 6 wherein said first and second sets of hinge components are disposed adjacent a base of said connector.

11. A gate for providing an opening in a barrier system comprising:

a stationary barrier segment;

a gate barrier segment; and a connector comprising first and second connector segments, wherein said first connector segment is releasably and non-pivotably coupled to said gate barrier segment with a first vertically removable connector pin, wherein said first and second connector segments are releasably coupled with a second vertically removable connector pin, wherein said second connector pin is moveable between an engaged position, wherein said first and second connector segments are non-pivotably coupled, and a disengaged position, wherein said first and second connector segments are pivotable relative to each other, and wherein said second connector segment is releasably and non-pivotably coupled to said stationary barrier segment with a third vertically removable connector pin, wherein said first and second connector segments each have opposite first and second sides having first and second horizontal lengths respectively, wherein said first and second lengths of each of said first and second connector segments are different, wherein said first lengths of said first and second connector segments are the same, and wherein said second lengths of said first and second connector segments are the same.

12. The gate of claim 11 wherein said first side of said first connector segment is aligned with said second side of said second connector segment and said second side of said first connector segment is aligned with said first side of said second connector segment, wherein said opposite sides of said connector have the same horizontal length.

13. A gate for providing an opening in a barrier system comprising:

a stationary barrier segment;

a gate barrier segment;

a connector comprising first and second connector segments, wherein said first connector segment is releasably and non-pivotably coupled to said gate barrier segment with a first vertically removable connector pin, wherein said first and second connector segments are releasably coupled with a second vertically removable connector pin, wherein said second connector pin is moveable between an engaged position, wherein said first and second connector segments are non-pivotably coupled, and a disengaged position, wherein said first and second connector segments are pivotable relative to each other, and wherein said second connector segment is releasably and non-pivotably coupled to said stationary barrier segment with a third vertically removable connector pin; and a coupler coupling to said first and second connector segments so as to prevent relative vertical movement between said first and second connector segments, wherein said coupler comprises a plate slidable between a disengaged position, wherein said first and second connector segments are vertically moveable relative to each other, and an engaged position, wherein said relative vertical movement between said first and second connector segments is prevented.

* * * * *